US011228138B2

(12) United States Patent
Gates et al.

(10) Patent No.: US 11,228,138 B2
(45) Date of Patent: Jan. 18, 2022

(54) LOCKING CONNECTOR CABLE SECURENESS ATTACHMENT ASSEMBLIES AND METHODS FOR PROTECTING ELECTRICAL CONNECTIONS IN A HAZARDOUS ENVIRONMENT

(71) Applicant: EATON INTELLIGENT POWER LIMITED, Dublin (IE)

(72) Inventors: Joshua Paul Gates, Kinston, NC (US); Michael Jarman, Roseboro, NC (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 16/919,631

(22) Filed: Jul. 2, 2020

(65) Prior Publication Data

US 2021/0006009 A1 Jan. 7, 2021

Related U.S. Application Data

(60) Provisional application No. 62/870,132, filed on Jul. 3, 2019.

(51) Int. Cl.
*H01R 13/58* (2006.01)
*H01R 13/629* (2006.01)

(52) U.S. Cl.
CPC ..... *H01R 13/58* (2013.01); *H01R 13/629* (2013.01)

(58) Field of Classification Search
CPC .... H01R 13/627; H01R 13/629; H01R 13/58; Y10T 403/60; Y10T 24/45267; F16G 15/04
See application file for complete search history.

(56) References Cited

U.S. PATENT DOCUMENTS

| | | | | |
|---|---|---|---|---|
| 2,143,985 | A | 1/1939 | Kellems | |
| 4,070,083 | A | 1/1978 | Dipalma | |
| 10,449,662 | B2 * | 10/2019 | Moreau | A45F 5/00 |
| 2017/0085026 | A1 | 3/2017 | Sandwith | |

* cited by examiner

*Primary Examiner* — Briggitte R. Hammond
(74) *Attorney, Agent, or Firm* — Armstrong Teasdale LLP

(57) ABSTRACT

A connector assembly for protecting electrical connections in a hazardous environment is provided. The connector assembly includes a first connector, a plug casting, and an elongated mesh grip. The plug casting circumscribes and is secured onto the first connector. The elongated mesh grip is coupled to the plug casting, the mesh grip including a mesh sized to surround the electrical cable, the mesh including a first end and a second end. The mesh has a diameter that is a transverse diameter of a channel defined by the mesh and configured to receive an electrical cable therethrough, wherein the diameter of the mesh decreases when one of the first and second ends of the mesh is pulled away from the other of the first and second ends of the mesh.

20 Claims, 4 Drawing Sheets

LOCKING CONNECTOR CABLE SECURENESS ATTACHMENT ASSEMBLIES AND METHODS FOR PROTECTING ELECTRICAL CONNECTIONS IN A HAZARDOUS ENVIRONMENT

CROSS REFERENCE TO RELATED APPLICATIONS

This application claims the benefit of U.S. Provisional Application No. 62/870,132, filed Jul. 3, 2019, the entire contents and disclosures of which are hereby incorporated by reference herein in their entirety.

BACKGROUND OF THE INVENTION

The field of the invention relates generally to medium voltage connector assemblies for industrial electrical power systems, and more particularly to industrial cable secureness attachment assemblies and methods for locking connector assemblies used in hazardous environments.

Conventional connector assemblies are known to include a plug coupled to a receptacle with electrical contacts included inside. The connectors, including plugs and receptacles, are in turn used to interconnect to electrical cables.

In hazardous industrial environments, such as mines, refineries and petroleum chemical plants, ignitable gas, vapors or dust or otherwise flammable substances are present in the ambient environment of the connector assemblies. In such environments, additional safeguards are therefore required, including but not necessarily limited to securing electrical connections inside the connectors to prevent possible ignition risks associated with a disconnection of a circuit under load in the hazardous environment.

While known secureness mechanisms and techniques are effective to provide the desired locking interconnections of connectors and electrical cables for industrial applications in hazardous environments, they are prone to certain problems and improvements are desired.

BRIEF DESCRIPTION OF THE DRAWINGS

Non-limiting and non-exhaustive embodiments are described with reference to the following Figures, wherein like reference numerals refer to like parts throughout the various drawings unless otherwise specified.

DETAILED DESCRIPTION

Conventional plug and receptacle electrical cable connectors for industrial purposes are disadvantaged in certain aspects, especially in a hazardous environment. For example, the electrical cable may be disengaged from the connector by the weight of the cable or other forces pulling the cable away from the connector while the connector and the cable are still energized, where any arc from disconnection could create an ignition source in the volatile atmosphere of the hazardous environment.

Electrical power systems sometimes operate within hazardous environments presenting a risk of explosion via ignition of a surrounding gas or vapor dusts, fibers, or flyings. Such hazardous environments may arise, for example only, in mines, petroleum refineries, petrochemical plants, grain silos, waste water and/or treatment facilities among other industrial facilities, wherein volatile conditions are produced in the ambient environment and present a heightened risk of fire or explosion. A temporary or sustained presence of airborne ignitable gas, vapors, or dust, or otherwise flammable substances presents substantial concerns regarding safe and reliable operation of such facilities overall. To transmit electrical power to the end user device, the electrical cable can be long and heavy. If the electrical cable becomes disengaged from a connector, both the connector and the electrical cable are still energized and pose great safety hazards in such environments. As such, a number of standards have been promulgated relating to electrical product use in explosive environments to improve safety in hazardous locations in view of an assessed probability of explosion or fire risk.

To meet the particular needs of hazardous environments, specialty locking connectors have been developed including compressive housing features to ensure connections of cables to the connectors and the connectors to one another. Such features include hose clamps and threaded rubber housings that may resist a tendency to inadvertently disengage when used. For example, known connectors of this type may be rated at 600 V and withstand a secureness test of 300 lbs. for one minute.

Under Canadian Standard Association (CSA) standards, a compression connector such as a plug and a receptacle rated above 1000 V is required to meet a cable secureness test of over 600 lbs., where a test electrical cable connected to the connector does not move more than a predetermined threshold distance after one minute when the test cable is attached with a weight of 600 lbs. Known compression connectors cannot meet this requirement.

The connector assemblies disclosed herein can be used reliably withstand a 600 lb. pull test to meet requirements for 1000 V use without having to design an entirely new connector system. As a result, an existing system can be used to meet higher power demand without significant changes to the components in the system.

Figure 1:
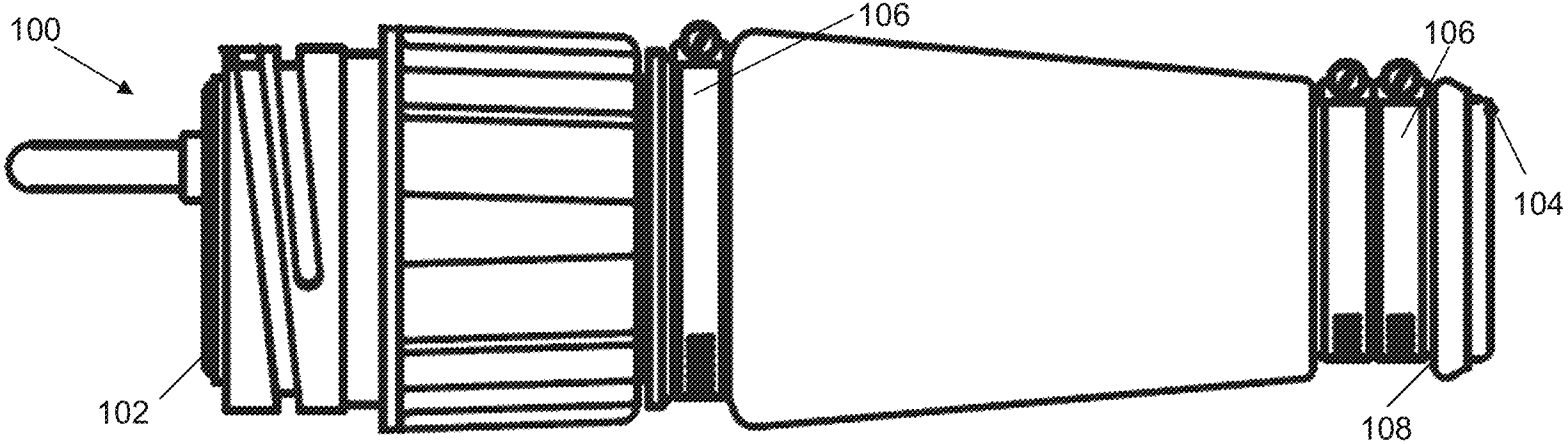
FIG. 1 (PRIOR ART)
FIG. 1 is a side view of a known compression connector.

FIG. 1 shows a known connector 100. Connector 100 is a female connector, which is configured to couple to a male connector. Connector 100 includes a first end 102 and a second end 104 opposite first end 102. First end 102 includes three female electrical contacts and a male ground contact. First end 102 may include sockets (not shown) configured to receive male electrical contacts carrying, for example, 3-phase electrical power of an alternating current (AC) power system operating at 1000 V. First end 102 is therefore configured to couple connector 100 to a complimentary connector, such as a male connector having projecting electrical contacts. Second end 104 of connector 100 is configured to couple to an electrical cable (not shown) for supplying electrical power to a load device. In operation, connector 100 is used to connect an electrical cable to a power supply by connecting the cable at second end 104 and connecting to a complimentary connector at first end 102 that is configured to be electrically coupled to a line-side power supply.

Connector 100 may further include a hose clamp 106. In operation, hose clamp 106 is clamped onto an outer surface 108 of connector 100 and limits the cable from being pulled out of connector 100 by the friction force between the cable jacket (not shown) and connector 100.

Figure 2:
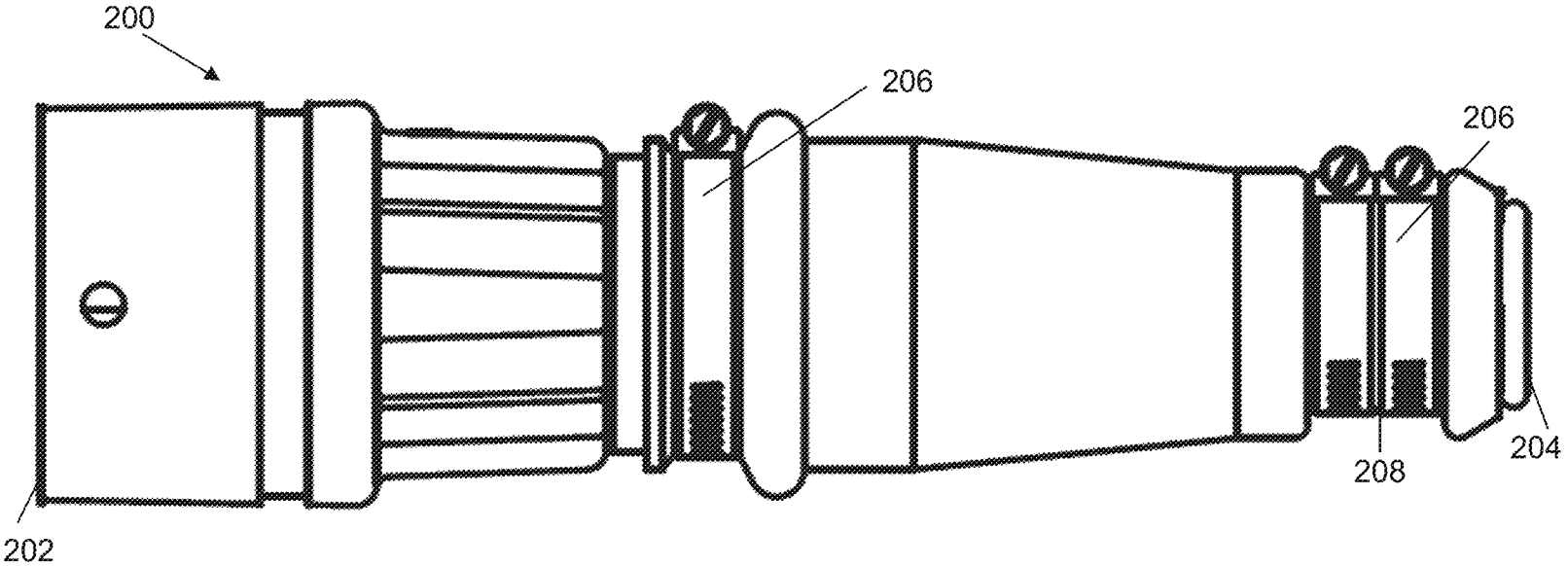
FIG. 2 (PRIOR ART)
FIG. 2 is a side view of another known compression connector.

FIG. 2 shows a side view of a known male connector 200. Connector 200 includes a first end 202 and a second end 204. First end 202 includes male electrical contacts (not shown). First end 202 may also include a slot (not shown) for receiving a ground contact. Second end 204 is configured to receive an electrical cable (not shown) of a line-side power supply. In operation, connector 200 is plugged-in to the complimentary female connector 100 via first end 202.

Connector 200 may also further include a hose clamp 206. In operation, hose clamp 206 is clamped onto an outer surface 208 of connector 200 and limits the cable from being pulled out of connector 200.

Connectors 100, 200 may be rated at 600 VAC or 1000 VAC, and may be recognized as medium voltage Quik-Loc™ plugs and receptacles of the Crouse-Hinds Series of Eaton Corporation. While connectors 100, 200 work well in hazardous environments such as mining applications, further improvements are desired.

Figure 3A:
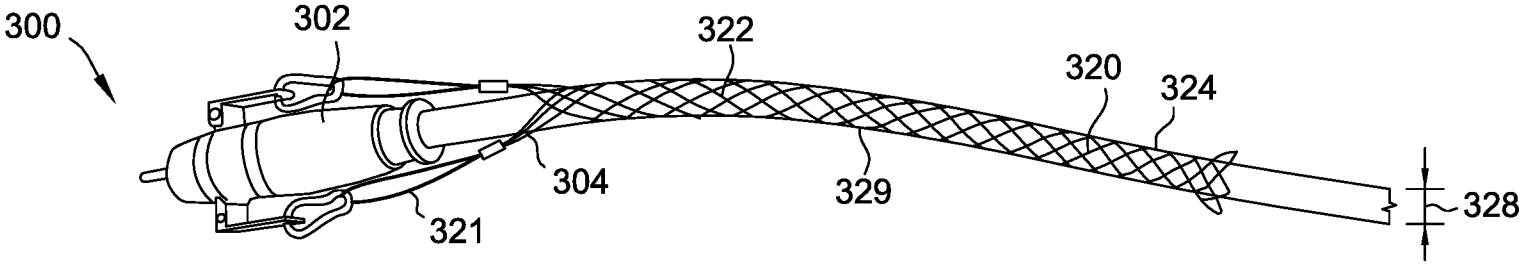
FIG. 3A is a perspective view of an exemplary female connector assembly according to a first embodiment of the invention.
Figure 3B:
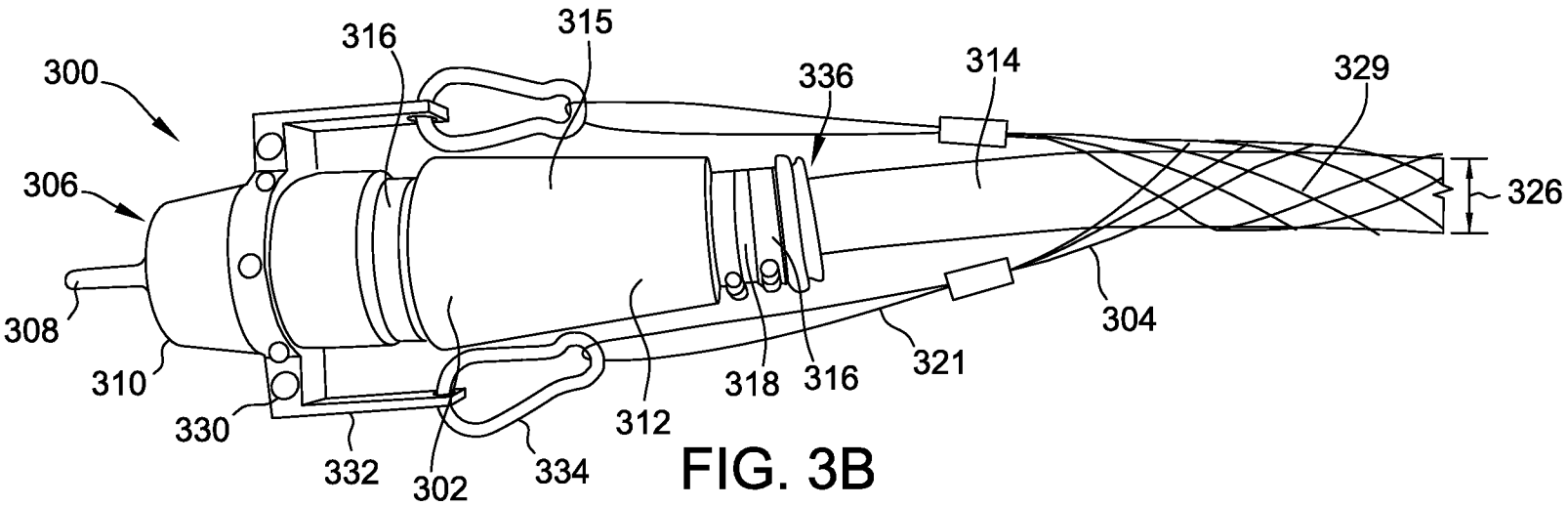
FIG. 3B is an enlarged view of the connector assembly shown in FIG. 3A.

FIGS. 3A and 3B show perspective views of an exemplary connector assembly 300 of the invention that meets significantly greater secureness requirements for 1000 V use in a mining operation. FIG. 3B is an enlarged view of connector assembly 300 shown in FIG. 3A. Connector assembly 300 includes a connector 302 and an elongated mesh grip 304. Connector assembly 300 may further include a plug casting 330.

Connector 302 is a female connector, which includes one or more slots 306 for receiving projecting electrical contacts that are configured to transmit electrical power. Connector 302 may also include a ground contact 308 for connecting to the ground.

Connector 302 includes a first end 310 and a second end 312. Electrical contact 308 and slots 306 are positioned at first end 310. Connector 302 is configured to receive an electrical cable 314 at second end 312 for supplying electrical power to an end user device. Connector 302 may include a sleeve 315 that is disposed on the outside of connector 302. Connector 302 may further include a hose clamp 316 that is clamped on an outer surface 318 of connector 302, clamping sleeve 315 onto connector 302 and cable 314. Hose clamp 316 may be made of stainless steel or other material that enables connector assembly 300 to function as described herein. In the exemplary embodiment, sleeve 315 is made of rubber such that sleeve 315 is pliable, durable, and chemical resistant. Therefore, sleeve 315 can be folded to allow ease of inserting cable 314 into connector 302 and afterwards unfolded to cover cable 314. Further, sleeve 315 is resistant to impacts and chemical corrosion in a rugged, harsh environment.

In the exemplary embodiment, mesh grip 304 includes a mesh 320. Mesh 320 may be formed by wires 329. In some embodiments, wires 329 may be interwoven to form mesh 320. Mesh 320 is, for example, a metal wire mesh. Mesh 320 may be made of other material that enables connector assembly 300 to function as disclosed herein, including but not limited to plastic. Mesh 320 includes a first end 322 and a second end 324. Mesh 320 defines a channel 327 configured to receive cable 314 therethrough. A diameter 326 of mesh 320 is defined as a transverse diameter 331 of channel 327. Diameter 326 of mesh 320 increases when one of first and second ends 322, 324 are pushed toward the other of first and second ends 322, 324. On the other hand, diameter 326 decreases when first and second ends 322, 324 are pulled away from each other. In other words, when mesh 320 is pushed or pulled along a longitudinal direction of mesh 320, diameter 326 of mesh 320 is increased or decreased.

In the exemplary embodiment, mesh grip 304 may further include one or more eye loops 321. In one example, eye loop 321 of mesh grip 304 is formed by wires 329 of mesh 320 being bundled together and forming into a loop.

To assemble cable 314 onto connector 302, one of first and second end 322, 324 is pushed toward the other of the first and second ends 322, 324 such that diameter 326 increases to be larger than a diameter 328 of cable 314. Cable 314 is then inserted into mesh 320 from second end 324 and out of mesh 320 at first end 322. Then, cable 314 is coupled with connector 302 at second end 312 of connector 302.

Connector assembly 300 may further include a plug casting 330. Plug casting 330 is secured onto connector 302 proximal to first end 310 of connector 302. Plug casting 330 may be made of metal, alloy, or any other material that enable connector assembly 300 to function as described herein.

Connector assembly 300 may also include a bracket 332 and a carabiner 334. In the exemplary embodiment, bracket 332 is coupled to plug casting 330. Bracket 332 may be formed as one piece with plug casting 330 or as separate pieces from plug casting 330. Bracket 332 and carabiner 334 may be made of copper, alloy, stainless steel, or any other material that enable connector assembly 300 to function as described herein. In the exemplary embodiment, connector assembly 300 includes two brackets 332, two carabiners 334, and two eye loops 321. Connector assembly 300 may include other number of brackets 332, carabiners 334, and eye loops 321, such as one or three.

In operation, eye loops 321 are coupled to carabiners 334 by inserting eye loops 321 into carabiners 334. Carabiners 334 are coupled to brackets 332, which are coupled to plug casting 330. In some embodiments, carabiners 334 are directly coupled to plug casting 330. When force such as weight of cable 314 or an external force is applied onto cable 314 to pull cable 314 away from its connection with connector 302, force in such a direction stretches wires 329 of mesh 320 and decreases diameter 326 of mesh 320. As a result, mesh 320 constricts and grips tight onto the jacket of cable 314 to hold cable 314 in place. In addition, force is transferred away from a connection point 336 between cable 314 and connector 302, and transferred onto plug casting 330 through mesh grip 304 and the coupling among mesh grip 304, carabiners 334, brackets 332, and plug casting 330.

Unlike connector 100, 302 which fails a 600 lb. pull test because of the rubber construction of sleeve 315 and reliance solely on the hose clamp 316 for strain relief, connector assembly 300 meets the 600 lb. pull test requirement for connectors of 1000 V rating because of the secureness attachment of connector assembly 300.

Figure 4A:
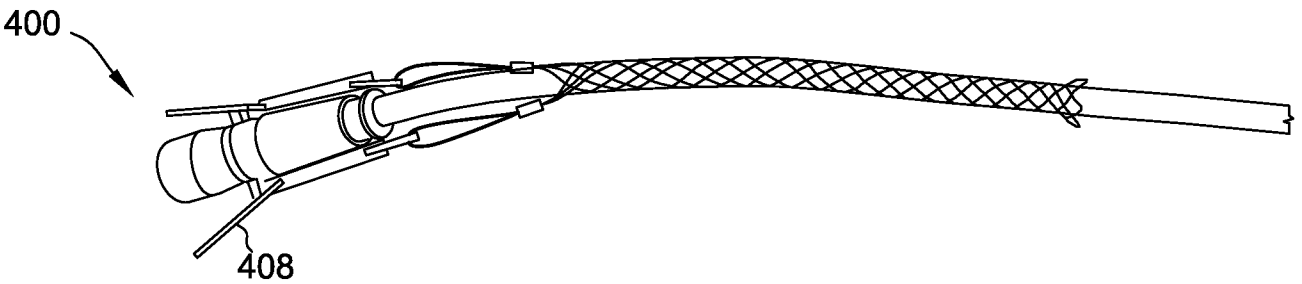
FIG. 4A is a perspective view of an exemplary male connector assembly according to a first embodiment of the invention.
Figure 4B:
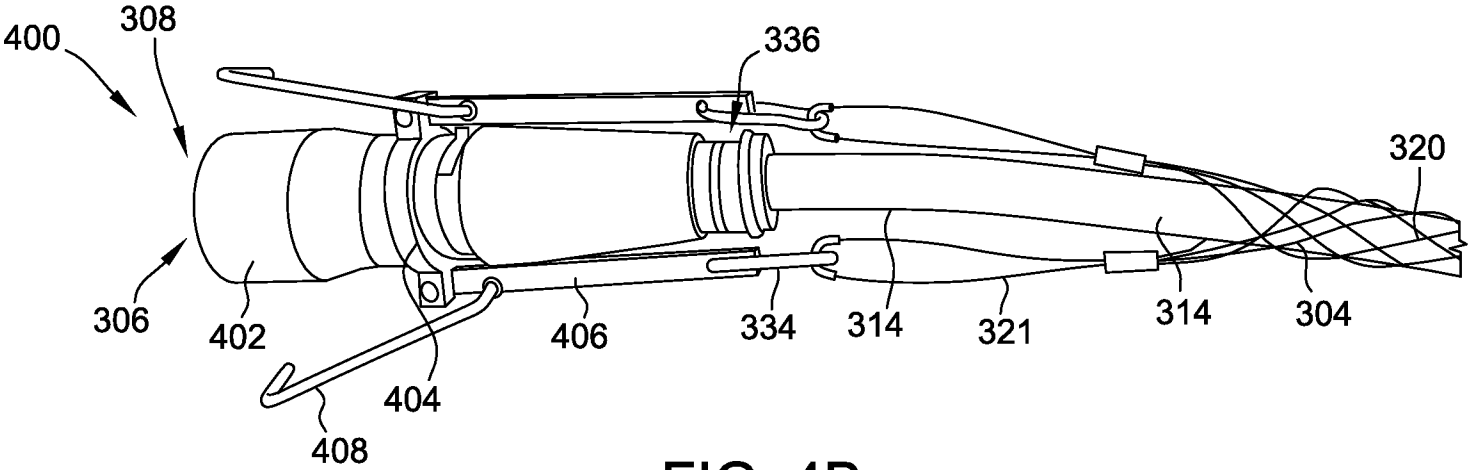
FIG. 4B is an enlarged view of the connector assembly shown in FIG. 4A.

FIGS. 4A and 4B show perspective views of another exemplary connector assembly 400. FIG. 4B is an enlarged view of connector assembly 400 shown in FIG. 4A. Different from connector assembly 300, connector assembly 400 includes a male connector 402 that includes projecting electrical contacts 308 configured to receive electrical power and may further include slot 306 for receiving a ground contact.

Connector assembly 400 includes connector 402 and mesh grip 304. Connector assembly 400 further includes plug casting 404. Plug casting 404 is secured onto connector 402. Connector assembly 400 may further include carabiners 334. Connector assembly 400 may also include a lever 406. In the exemplary embodiment, lever 406 is movably coupled to plug casting 404. In some embodiments, lever 406 is fixedly coupled to plug casting 404, similar to bracket 332 of connector assembly 300. Connector assembly 400 may further include a clamp bar 408. Clamp bar 408 is used to couple connector 402 to a complimentary connector. For example, the complimentary connector is a receptacle and clamp bar 408 is inserted into a slot on the receptacle to couple connector 402 to the receptacle. In some embodiments, the complimentary connector is female connector 302, and clamp bar 408 may be inserted into a slot 333 on plug casting 330 that is secured onto female connector 302 (see FIG. 3B). Lever 406 and clamp bar 408 may be rotatably coupled. In operation, lever 406 may be moved such that clamp bar 408 rotates in or out of engagement with a complimentary connector.

Similarly, cable 314 is secured onto connector 402 with force transferred away from connection point 336 between connector 402 and cable 314 and transferred onto plug casting 404 through mesh grip 304 and coupling among mesh grip 304, carabiners 334, lever 406, and plug casting 404. In the exemplary embodiment, connector assembly 400 includes two levers 406, two carabiners 334, and two eye loops 321. Connector assembly 400 may include other number of levers 406, carabiners 334, and eye loop 321, such as one or three.

Figure 5:
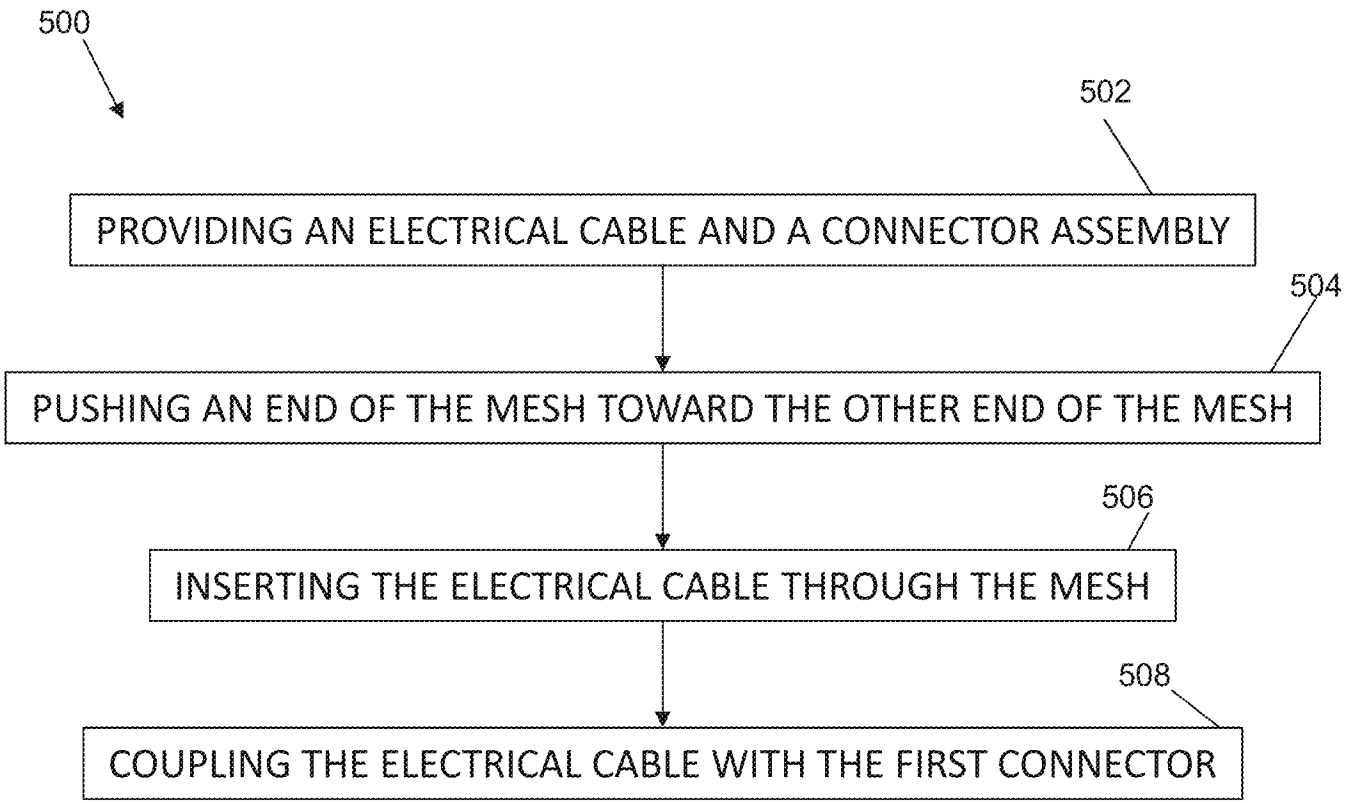
FIG. 5 is a flow chart illustrating an exemplary method of securing an electrical cable with a connector assembly shown in FIGS. 3A-4B.

FIG. 5 shows an exemplary method 500 of securing an electrical cable. Method 500 includes providing 502 an electrical cable and a connector assembly. The connector assembly may include any of the examples or embodiments described above. Method 500 further includes pushing 504 one of the first and second ends of the mesh of the connector assembly toward the other one of the first and second ends of the mesh such that the diameter of the mesh increases and becomes greater than the diameter of the electrical cable. Method 500 also includes inserting 506 the electrical cable through the mesh. Further, method 500 includes coupling 508 the electrical cable with the connector of the connector assembly. Method 500 may further include pulling one of the first and second ends of the mesh such that the mesh gets in contact with an exterior of the electrical cable.

Various embodiments of connector assemblies are described herein including a mesh grip, where the strain on the connection point between a connector and an electrical cable is transferred away from the connection point to the plug casting of the connector, thereby increasing the safety of connector assemblies, as well as complying with the CSA standards for a higher rating than the connector by itself. Further, existing systems can be used to meet higher demand for electrical power with few changes to the system components, thereby saving costs in upgrading electrical systems.

While exemplary embodiments of components, assemblies and systems are described, variations of the components, assemblies and systems are possible to achieve similar advantages and effects. Specifically, the shape and the geometry of the components and assemblies, and the relative locations of the components in the assembly, may be varied from that described and depicted without departing from inventive concepts described. Also, in certain embodiments, certain components in the assemblies described may be omitted to accommodate particular types of fuses or the needs of particular installations, while still providing the needed performance and functionality of the fuses.

The benefits and advantages of the inventive concepts are now believed to have been amply illustrated in relation to the exemplary embodiments disclosed.

An embodiment of a connector assembly for protecting electrical connections in a hazardous environment is disclosed. The connector assembly includes a first connector, a plug casting, and an elongated mesh grip. The first connector includes a first end and a second end opposite the first end, the first end including a plurality of electrical contacts configured to be electrically coupled to a complimentary connector, wherein the first connector is configured to receive an electrical cable at the second end. The plug casting circumscribes and is secured onto the first connector. The elongated mesh grip is coupled to the plug casting, the mesh grip including a mesh sized to surround the electrical cable, the mesh including a first end and a second end. The mesh has a diameter that is a transverse diameter of a channel defined by the mesh and configured to receive the electrical cable therethrough, wherein the diameter of the mesh decreases when one of the first and second ends of the mesh is pulled away from the other of the first and second ends of the mesh.

Optionally, the first connector is a female connector, the connector assembly further including one or more brackets extending from the plug casting and one or more carabiners coupled to the mesh grip and the brackets. Alternatively, the first connector is a male connector, the connector assembly further including one or more levers coupled to the plug casting and one or more carabiners coupled to the levers and the mesh grip. The connector assembly further includes a clamp bar rotatably coupled to one of the levers and configured to couple to the complimentary connector. The mesh grip is a wire mesh grip. The wire mesh grip includes a plurality of wires interweaving and forming the mesh. The connector assembly further includes one or more carabiners coupled to the plug casting, the mesh grip forms one or more eye loops, and the one or more eye loops are inserted into the one or more carabiners.

An embodiment of a method of securing an electrical cable is disclosed. The method includes providing an electrical cable and a connector assembly, wherein the connector assembly includes a first connector, a plug casting secured onto the first connector, and an elongated mesh grip including a mesh sized to surround the electrical cable. The first connector includes a first end and a second end opposite the first end, the first end of the first connector including a plurality of electrical contacts configured to be electrically coupled to a complimentary connector. The first connector is configured to receive the electrical cable at the second end. The mesh has a diameter that is a transverse diameter of a channel defined by the mesh and configured to receive the electrical cable therethrough, wherein the diameter of the mesh decreases when the mesh is pulled along a longitudinal direction of the mesh, the mesh having a first end and a second end. The method further includes pushing one of the first and second ends of the mesh toward the other of the first and second ends of the mesh such that a diameter of the mesh is greater than a diameter of the electrical cable. The method also includes inserting the electrical cable through the mesh. Further, the method includes coupling the electrical cable with the first connector. Moreover, the method includes pulling one of the first and second ends of the mesh away from the other of the first and second ends of the mesh until the mesh is in contact with an exterior of the electrical cable.

Optionally, in the method, the first connector is a female connector, the connector assembly further including one or more brackets extending from the plug casting; and one or more carabiners coupled to the mesh grip and the brackets. Alternatively, the first connector is a male connector, the connector assembly further including one or more levers coupled to the plug casting, and one or more carabiners coupled to the levers and the mesh grip. The connector assembly further includes a clamp bar rotatably coupled to one of the levers and configured to couple to the complimentary connector. The mesh grip is a wire mesh grip. The wire mesh grip includes a plurality of wires interweaving and forming the mesh. The connector assembly further includes one or more carabiners coupled to the plug casting, the mesh grip forms one or more eye loops, and the one or more eye loops are inserted into the one or more carabiners.

Another embodiment of a connector assembly for protecting electrical connections in a hazardous environment is disclosed. The connector assembly includes a female connector, a male connector, a plug casting, and an elongated mesh grip. The female connector includes a first end and a second end opposite the first end, the first end including a plurality of electrical contacts, wherein the female connector is configured to receive a first electrical cable at the second end. The male connector includes a first end and a second end opposite the first end, the first end including a plurality of electrical contacts and coupled to the female connector at the first end of the female connector, wherein in the male connector is configured to receive a second electrical cable at the second end of the male connector. The plug casting circumscribes and is secured onto one of the female connector and the male connector. The elongated mesh grip is coupled to the plug casting, the mesh grip including a mesh sized to surround one of the first electrical cable and the second electrical cable. The mesh includes a first end and a second end, the mesh having a diameter that is a transverse diameter of a channel defined by the mesh and configured to receive the one of the first electrical cable and the second electrical cable therethrough. The diameter of the mesh decreases when one of the first and second ends of the mesh is pulled away from the other of the first and second ends of the mesh.

Optionally, the plug casting is a first plug casting circumscribing and secured onto the female connector, the elongated mesh grip is a first elongated mesh grip coupled to the first plug casting and including a first mesh sized to surround the first electrical cable. The connector assembly further includes a second plug casting and a second elongated mesh grip. The second plug casting circumscribes and is secured onto the male connector. The second elongated mesh grip is coupled to the second plug casting and includes a second mesh sized to surround the second electrical cable. Alternatively, the plug casting circumscribes and is secured onto the female connector, the mesh sized to surround the first electrical cable, the connector assembly further including one or more brackets extending from the plug casting and one or more carabiners coupled to the mesh grip and the brackets. Alternatively, the plug casting circumscribes and is secured onto the male connector, the mesh sized to surround the second electrical cable, the connector assembly further including one or more levers coupled to the plug casting, and one or more carabiners coupled to the levers and the mesh grip. The connector assembly further includes a clamp bar rotatably coupled to one of the levers and configured to couple to the female connector. The connector assembly further includes one or more carabiners coupled to the plug casting, wherein the mesh grip forms one or more eye loops, and the one or more eye loops are inserted into the one or more carabiners.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A connector assembly for protecting electrical connections in a hazardous environment, comprising:

a first connector comprising a first end and a second end opposite the first end, the first end comprising a plurality of electrical contacts configured to be electrically coupled to a complimentary connector, wherein the first connector is configured to receive an electrical cable at the second end;

a plug casting circumscribing and secured onto the first connector; and an elongated mesh grip coupled to the plug casting, the mesh grip including a mesh sized to surround the electrical cable, the mesh including a first end and a second end, the mesh having a diameter that is a transverse diameter of a channel defined by the mesh and configured to receive the electrical cable therethrough, wherein the diameter of the mesh decreases when one of the first and second ends of the mesh is pulled away from the other of the first and second ends of the mesh, wherein the connector assembly is configured to prevent possible ignition risks associated with a disconnection of a 1000V circuit under load in the hazardous environment when subjected to a pull force of about 600 pounds.

2. The connector assembly of claim 1, wherein the first connector is a female connector, the connector assembly further comprising:

one or more brackets extending from the plug casting; and one or more carabiners coupled to the mesh grip and the brackets.

3. The connector assembly of claim 1, wherein the first connector is a male connector, the connector assembly further comprising:

one or more levers coupled to the plug casting; and one or more carabiners coupled to the levers and the mesh grip.

4. The connector assembly of claim 3, further comprising a clamp bar rotatably coupled to one of the levers and configured to couple to the complimentary connector.

5. The connector assembly of claim 1, wherein the mesh grip is a wire mesh grip.

6. The connector assembly of claim 5, wherein the wire mesh grip comprises a plurality of wires interweaving and forming the mesh.

7. The connector assembly of claim 1, further comprising one or more carabiners coupled to the plug casting, wherein the mesh grip forms one or more eye loops, and the one or more eye loops are inserted into the one or more carabiners.

8. A method of securing an electrical cable, the method comprising:

providing an electrical cable and a connector assembly, wherein the connector assembly includes a first connector, a plug casting secured onto the first connector, and an elongated mesh grip including a mesh sized to surround the electrical cable, the first connector including a first end and a second end opposite the first end, the first end of the first connector including a plurality of electrical contacts configured to be electrically coupled to a complimentary connector, wherein the first connector is configured to receive the electrical cable at the second end, the mesh having a diameter that is a transverse diameter of a channel defined by the mesh and configured to receive the electrical cable therethrough, wherein the diameter of the mesh decreases when the mesh is pulled along a longitudinal direction of the mesh, the mesh having a first end and a second end;

pushing one of the first and second ends of the mesh toward the other of the first and second ends of the mesh such that a diameter of the mesh is greater than a diameter of the electrical cable;

inserting the electrical cable through the mesh;

coupling the electrical cable with the first connector; and pulling one of the first and second ends of the mesh away from the other of the first and second ends of the mesh until the mesh is in contact with an exterior of the electrical cable, wherein the connector assembly is configured to prevent possible ignition risks associated with a disconnection of a 1000V circuit under load in a hazardous environment when subjected to a pull force of about 600 pounds.

9. The method of claim 8, wherein the first connector is a female connector, the connector assembly further comprising:

one or more brackets extending from the plug casting; and one or more carabiners coupled to the mesh grip and the brackets.

10. The method of claim 8, wherein the first connector is a male connector, the connector assembly further comprising:

one or more levers coupled to the plug casting; and one or more carabiners coupled to the levers and the mesh grip.

11. The method of claim 10, wherein the connector assembly further comprises a clamp bar rotatably coupled to one of the levers and configured to couple to the complimentary connector.

12. The method of claim 8, wherein the mesh grip is a wire mesh grip.

13. The method of claim 12, wherein the wire mesh grip comprises a plurality of wires interweaving and forming the mesh.

14. The method of claim 8, wherein the connector assembly further includes one or more carabiners coupled to the plug casting, the mesh grip forms one or more eye loops, and the one or more eye loops are inserted into the one or more carabiners.

15. A connector assembly for protecting electrical connections in a hazardous environment, comprising:

a female connector comprising a first end and a second end opposite the first end, the first end comprising a plurality of electrical contacts, wherein the female connector is configured to receive a first electrical cable at the second end;

a male connector comprising a first end and a second end opposite the first end, the first end comprising a plurality of electrical contacts and coupled to the female connector at the first end of the female connector, wherein in the male connector is configured to receive a second electrical cable at the second end of the male connector;

a plug casting circumscribing and secured onto one of the female connector and the male connector; and an elongated mesh grip coupled to the plug casting, the mesh grip including a mesh sized to surround one of the first electrical cable and the second electrical cable, the mesh including a first end and a second end, the mesh having a diameter that is a transverse diameter of a channel defined by the mesh and configured to receive the one of the first electrical cable and the second electrical cable therethrough, wherein the diameter of the mesh decreases when one of the first and second ends of the mesh is pulled away from the other of the first and second ends of the mesh, wherein the connector assembly is configured to prevent possible ignition risks associated with a disconnection of a circuit under load in the hazardous environment.

16. The connector assembly of claim 15, wherein the plug casting is a first plug casting circumscribing and secured onto the female connector, the elongated mesh grip is a first elongated mesh grip coupled to the first plug casting and including a first mesh sized to surround the first electrical cable, the connector assembly further comprising:

a second plug casting circumscribing and secured onto the male connector; and a second elongated mesh grip coupled to the second plug casting and including a second mesh sized to surround the second electrical cable.

17. The connector assembly of claim 15, wherein the plug casting circumscribes and is secured onto the female connector, the mesh sized to surround the first electrical cable, the connector assembly further comprising:

one or more brackets extending from the plug casting; and one or more carabiners coupled to the mesh grip and the brackets.

18. The connector assembly of claim 15, wherein the plug casting circumscribes and is secured onto the male connector, the mesh sized to surround the second electrical cable, the connector assembly further comprising:

one or more levers coupled to the plug casting; and one or more carabiners coupled to the levers and the mesh grip.

19. The connector assembly of claim 18, further comprising a clamp bar rotatably coupled to one of the levers and configured to couple to the female connector.

20. The connector assembly of claim 15, further comprising one or more carabiners coupled to the plug casting, wherein the mesh grip forms one or more eye loops, and the one or more eye loops are inserted into the one or more carabiners.

* * * * *